US006302353B1

(12) United States Patent
Motegi et al.

(10) Patent No.: US 6,302,353 B1
(45) Date of Patent: Oct. 16, 2001

(54) TURNING BAR APPARATUS

(75) Inventors: Akira Motegi, Kanagawa Pref.; Kinichiroh Ohno, Tokyo, both of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/568,289

(22) Filed: May 10, 2000

(30) Foreign Application Priority Data

Nov. 9, 1999 (JP) ..... 11-318648

(51) Int. Cl.[7] ..... B65H 23/24; B65H 23/32
(52) U.S. Cl. ..... 242/615.12
(58) Field of Search ..... 242/615.12, 615.11, 242/615.21; 226/97.3

(56) References Cited

U.S. PATENT DOCUMENTS 3,587,598 * 6/1971 Miyamatsu et al. ..... 242/615.12
5,316,199 * 5/1994 Hansen et al. ..... 242/615.12

FOREIGN PATENT DOCUMENTS 5-28632 4/1993 (JP) .
5-32353 4/1993 (JP) .
6-345306 12/1994 (JP) .

* cited by examiner

*Primary Examiner*—John M. Jillions
(74) *Attorney, Agent, or Firm*—Armstrong, Westerman, Hattori, McLeland & Naughton, LLP

(57) ABSTRACT

A turning bar apparatus includes a stationary turning bar assuming the form of a hollow cylinder and adapted to change the running direction of a web looped therearound and a compressed-air supply unit for supplying compressed air into the hollow interior of the turning bar. A plurality of air outlet openings are formed through the wall of the turning bar and are arranged in rows and along the longitudinal direction of the turning bar. At least a single row of air outlet openings is arranged in an upstream portion of a web-looping region extending between an upstream end of the web-looping region and a circumferential center of the web-looping region. At least a single row of air outlet openings is arranged in a downstream portion of the web-looping region extending between the circumferential center of the web-looping region and a downstream end of the web-looping region.

6 Claims, 6 Drawing Sheets

TURNING BAR APPARATUS

BACKGROUND OF THE INVENTION

1. Field of the Invention

The present invention relates to a turning bar apparatus disposed in a running path of a web and adapted to change the running direction of the web.

2. Description of the Related Art

Conventionally, air outlet openings are formed in a turning bar disposed in a web path, in order to cause a web looped around the turning bar to float above the outer circumferential surface of the turning bar by means of air discharged therethrough. Such a turning bar is disclosed in, for example, Japanese Utility Model Application Laid-Open (kokai) Nos. 5-28632 "Turning bar Apparatus" and 5-32353 "Web Guide Roll" and Japanese Patent Application Laid-Open (kokai) No. 6-345306 "Turning Bar."

FIG. 6 shows the turning bar apparatus (hereinafter, called the first conventional art) disclosed in Japanese Utility Model Application Laid-Open (kokai) No. 5-28632. As shown in FIG. 6, a turning bar 30 of the turning bar apparatus includes an exterior pipe 32 having a hollow space 31 formed therein. A number of air outlet openings 33 are formed in the exterior pipe 32 so as to extend from the hollow space 31 to the outer circumferential surface of the exterior pipe 32, which comes into contact with a web W.

The air outlet openings 33 are positioned in the circumferential direction of the exterior pipe 32 at: a web-looping-region upstream-end-portion 34 of the turning bar 30; a web-looping-region downstream-end-portion 35 of the turning bar 30; a web-looping-region center-portion 39 located at the center between the web-looping-region upstream-end-portion 34 and the web-looping-region downstream-end-portion 35; a web-looping-region upstream-portion 37 extending between the web-looping-region upstream-end-portion 34 and the web-looping-region center-portion 39; and a web-looping-region downstream-portion 38 extending between the web-looping-region downstream-end-portion 35 and the web-looping-region center-portion 39. In each of the positions, a plurality of air outlet openings 33 are arranged in a row along the longitudinal direction of the turning bar 30.

The turning bar 30 is disposed in a web path of a rotary press. Compressed air supplied to the hollow space 31 is discharged through the air outlet openings 33 formed in the turning bar 30 so as to cause the web W to float above the outer circumferential surface of the exterior pipe 32, thereby preventing blurred printing which might otherwise result from rubbing or contact between the web W and the outer circumferential surface of the turning bar 30.

Japanese Utility Model Application Laid-Open (kokai) No. 5-28632 (hereinafter, called the second conventional art) also discloses a turning bar apparatus improved from the turning bar apparatus of the first conventional art. According to the second conventional art, an air duct is disposed on the side of the exterior pipe 32 where the web W does not contact the exterior pipe 32. Compressed air is supplied to the air duct. Nozzles are attached to the air duct so as to discharge compressed air therethrough in a direction tangent to the exterior pipe 32 toward the web-looping-region upstream-end-portion 34, where the web W begins to be looped around the exterior pipe 32, and toward the web-looping-region downstream-end-portion 35, where the web W leaves the exterior pipe 32. According to the second conventional art, through discharge of compressed air through the nozzles, the web W is caused to be floated farther above the outer circumferential surface of the exterior pipe 31.

According to Japanese Patent Application Laid-Open (kokai) No. 6-345306 (hereinafter, called the third conventional art), as shown in FIGS. 8A and 8B, a turning bar 2 for changing the running direction of a web 1 by substantially a right angle is disposed in combination with an upstream guide roller 13 and a downstream guide roller 14. The upstream guide roller 13 is adapted to lead the web 1 toward the turning bar 2 and is disposed upstream of the turning bar 2 with respect to the direction of travel of the web 1 such that an axis level thereof is equal to that of the turning bar 2 and such that phase thereof differs 45 degrees from that of the turning bar 2. The downstream guide roller 14 causes the web 1 to separate from the turning bar 2 and is disposed downstream of the turning bar 2 such that an axis level thereof is equal to that of the turning bar 2 and such that phase thereof differs 45 degrees from that of the turning bar 2 and 90 degrees from that of the upstream guide roller 13.

At least three rows of nozzles 5 are arranged on the surface of the turning bar 2 along the longitudinal direction of the turning bar 2 over a length corresponding to the width of the web 1, as well as within a circumferential web-looping region of the turning bar 2. The nozzles 5 are arranged at longitudinally equal intervals over a portion or the entirely of the length corresponding to the width of the web 1. Central angles defined by adjacent rows of nozzles 5 are equal to each other. An additional row of nozzles 5 is arranged longitudinally inward and at greater density than are the three rows of nozzles 5 on the surface of the turning bar 2 over an appropriate length from a portion of the turning bar 2 corresponding to a web side edge portion at which the length of the web 1 extending between the upstream guide roller 13 and the turning bar 2 is shorter than that as measured at the other web side edge. Similarly, an additional row of nozzles 5 is arranged longitudinally inward and at greater density than are the three rows of nozzles 5 on the surface of the turning bar 2 over an appropriate length from a portion of the turning bar 2 corresponding to a web side edge portion at which the length of the web 1 extending between the downstream guide roller 14 and the turning bar 2 is shorter than that as measured at the other web side edge. Through such arrangement of nozzles 5, compressed air is supplied in greater amount to a portion of the web 1 which would otherwise be floated to a lesser extent, thereby establishing sufficient floating of the web 1 over the length of the turning bar 2.

As shown in FIGS. 9A and 9B, a web guide roll 2 (hereinafter, called the fourth conventional art) disclosed in Japanese Utility Model Application Laid-Open (kokai) No. 5-32353 is used for changing the running direction of a web 1 while the web 1 is floated above the surface thereof by means of air. A plurality of small holes 4 are formed in a web-looping region of the web guide roll 2 so as to discharge air therethrough for floating the web 1. The small holes 4 are distributed on the web guide roll 2 circumferentially within a range from the position where the web 1 begins to be looped around the web guide roll 2, to the position of a quarter circumference. In addition to the small holes 4, Coanda-type slits 5 (or a row of Coanda-type small holes 5') are formed for discharging air therethrough.

On the upstream side of a region of distributed small holes 4, a longitudinal Coanda-type slit 5 or a row of Coanda-type small holes (not shown) is arranged along the axial direction of the guide roll 2 such that air is discharged therethrough in an inclined manner so as to follow travel of the web 1. On the downstream side of the region of distributed small holes 4, a longitudinal Coanda-type slit 5 or a row of Coanda-type small holes (not shown) is arranged along the axial direction of the guide roll such 2 that air is discharged therethrough in an inclined manner so as to flow against travel of the web 1. Circumferential Coanda-type slits 5' are formed on the opposite sides of the region of distributed small holes 4 with respect to the web-width direction such that air is discharged therethrough in an inclined manner so as to flow inward with respect to the axial direction of the guide roll 2.

Through discharge of air from the Coanda-type slits 5' and a row of Coanda-type small holes (not shown) and from the Coanda-type slits 5', the ratio of the amount of escaping air to the amount of air discharged from the small holes 4 is reduced, thereby enhancing floating of the web 1.

However, the above-described conventional arts involve the following problems.

In the turning bar apparatus according to the first and second conventional arts, as shown in FIG. 6, a floating force exerted by air discharged from the air outlet openings 33 arranged longitudinally along the turning bar 30 at the web-looping-region center-portion 39 is directed against a resultant force of a tension T of a web W1 which runs toward the turning bar 30 and a tension T of a web W2 which leaves the turning bar 30. Thus, the floating force is directly subjected to the resultant force; i.e., 2T. As the web tensions T increase, the gap between the web W and the surface of the exterior pipe 32 decreases as shown in FIG. 7A; i.e., the web tensions T function toward blocking the air outlet openings 33.

As a result, as in the case where blowing cellophane paper under tension causes vibration of the paper, the web W jitters across its width. Such jittering causes the web W to move widthwise, or to undergo transverse paper shift. Jittering of the web W increases with the pressure of compressed air 36, causing not only transverse paper shift but also imposition of an unnecessarily strong tension on the web W with resultant unstable travel of the web W.

Also, as shown in FIG. 6, at the web-looping-region upstream-end-portion 34 and at the web-looping-region downstream-end-portion 35, a floating force exerted by air discharged from the longitudinally arranged air outlet openings 33 is directed substantially perpendicular to the tension T of the web W1 and to the tension T of the web W2, respectively. Thus, a force for pressing the web W1 (W2) toward the air outlet openings 33 is not directly influenced by the web tension T.

That is, since no force is generated for pressing toward the air outlet openings 33 the web W1 running toward the turning bar 30 and the web W2 leaving the turning bar 30, travel of the web W becomes unstable. Particularly, when the web tensions T are weak, the compressed air 36 is discharged against the web W which is running unstably, causing the web W to flutter. The fluttering web W closes and opens in an irregular manner the longitudinally arranged air outlet openings 33. As a result, air flow balance within the gap between the web W and the outer circumferential surface of the exterior pipe 32 tends to be destroyed with respect to the web width direction, although air flow balance is maintained with respect to the circumferential direction of the turning bar 30. Thus, the web W is likely to move widthwise.

Increased supply of the compressed air 36 causes unnecessarily intensive floating of the web W, causing increased fluttering of the web W. Thus, travel of the web W becomes more unstable.

Therefore, since the supply of the compressed air 36 is must be decreased, the web W fails to float sufficiently, causing rubbing between the turning bar 30 and the web W with resultant blurred printing. Further, the air outlet openings 33 may become clogged with ink and paper dust.

In the turning bar according to the third conventional art, a number of nozzles are arranged at a portion of the turning bar which is in contact with the web. Further, since a row of nozzles is arranged along the axial direction of the turning bar at the circumferential center of the web-looping region, the turning bar causes a phenomenon similar to the phenomenon induced by a row of air outlet openings arranged at the web-looping-region center-portion 39 in the first and second conventional arts.

Also, nozzles are arranged at greater density at portions of the turning bar corresponding to side edge portions of the looped web than at an intermediate portion of the turning bar. As in the case shown in FIG. 7B, air discharged from those nozzles which are located in correspondence with the side edge portions of the web may turn up the side edge portions of the web, thereby disturbing a floating state of the web. As a result, air flow balance within the gap between the web and the web-looping region of the turning bar tends to be destroyed with respect to the web width direction, while air flow balance is rather maintained with respect to the circumferential direction of the turning bar. Thus, the web is likely to move widthwise. Particularly, when the supply of compressed air is increased, the side edge portions of the web become more likely to be turned up; thus, the web becomes more likely to move widthwise.

Therefore, since the supply of compressed air must be decreased, the web fails to float sufficiently, causing rubbing between the turning bar and the web with resultant blurred printing. Further, the nozzles may become clogged with ink and paper dust.

In the guide roll (turning bar) according to the fourth conventional art, at a portion of the guide roll where the web begins to be looped around the guide roll and at a portion of the guide roll where the web leaves the guide roll, a floating force exerted by air discharged from the longitudinally arranged air outlet holes is directed substantially perpendicular to tension associated with the approaching web and to tension associated with the leaving web, respectively. Thus, a force for pressing the web toward the air outlet holes is not directly influenced by the web tension.

That is, since no force is generated for pressing toward the air outlet holes the web running toward the guide roll and the web leaving the guide roll, travel of the web becomes unstable. Particularly, when the web tension is weak, compressed air is discharged against the web which is running unstably, causing the web to flutter. The fluttering web closes and opens in an irregular manner the longitudinally arranged air outlet holes. As a result, air flow balance within the gap between the web and the web-looping region of the guide roll tends to be destroyed with respect to the web width direction, while air flow balance is rather maintained with respect to the circumferential direction of the guide roll. Thus, the web is likely to move widthwise. Increased supply of compressed air causes unnecessarily intensive floating of the web, causing increased fluttering of the web. Thus, travel of the web becomes more unstable.

Also, as in the case shown in FIG. 7B, air discharged from those nozzles which are located at portions of the guide roll corresponding to the side edge portions of the web may turn up the side edge portions of the web, thereby disturbing a floating state of the web. As a result, air flow balance within the gap between the web and the web-looping region of the guide roll tends to be destroyed with respect to the web width direction, while air flow balance is rather maintained with respect to the circumferential direction of the guide roll. Thus, the web is likely to move widthwise. Particularly, when the supply of compressed air is increased, the side edge portions of the web become more likely to be turned up; thus, the web becomes more likely to move widthwise.

Therefore, since the supply of compressed air must be decreased, the web fails to float sufficiently, causing rubbing between the guide roll and the web with resultant blurred printing. Further, the air outlet holes may become clogged with ink and paper dust.

SUMMARY OF THE INVENTION

An object of the present invention is to solve the above-mentioned problems involved in the conventional turning bar apparatus and to provide a turning bar apparatus allowing a web to stably float above a web-looping region of the outer circumferential surface of a turning bar, allowing the web to run, with reduced resistance, along the outer circumferential surface of the turning bar, involving smaller fluctuations of web tension, enabling stable travel of the web without involvement of transverse web shift, capable of providing good printing quality without dirtying a printed paper surface, and involving less clogging of air outlet openings with ink and paper dust to thereby facilitate maintenance thereof.

To achieve the above object, the present invention provides a turning bar apparatus comprising a stationary turning bar assuming the form of a hollow cylinder and adapted to change the running direction of a web looped therearound and a compressed-air supply unit for supplying compressed air into the hollow interior of the turning bar. A plurality of air outlet openings are formed in the turning bar in a plurality of rows and along the longitudinal direction of the turning bar. The air outlet openings extend through the wall of the turning bar between the hollow interior of the turning bar and the outer circumferential surface of the turning bar. The rows of air outlet openings are not located at a web-looping-region upstream-end-portion, which is a circumferential position of the turning bar where the web running toward the turning bar begins to be looped around the turning bar; at a web-looping-region downstream-end-portion, which is a circumferential position of the turning bar where the web looped around the turning bar begins to leave the turning bar; or at a web-looping-region center-portion, which is a circumferentially center position of the turning bar between the web-looping-region upstream-end-portion and the web-looping-region downstream-end-portion. At least a single row of air outlet openings is arranged in a web-looping-region upstream-portion extending between the web-looping-region upstream-end-portion and the web-looping-region center-portion. At least a single row of air outlet openings is arranged in a web-looping-region downstream-portion extending between the web-looping-region center-portion and the web-looping-region downstream-end-portion.

Preferably, air outlet openings positioned at opposite ends of each row of air outlet openings are located 50 mm to 150 mm inward from positions on the turning bar corresponding to side edges of the web looped around the turning bar.

Preferably, the rows of air outlet openings are located within a circumferential range encompassing central angles of 5 degrees to 60 degrees with respect to the web-looping-region center-portion.

Preferably, a single row of air outlet openings is arranged within the web-looping-region upstream-portion in such a manner so as to assume a central angle of substantially 45 degrees with respect to the web-looping-region center-portion, and a single row of air outlet openings is arranged within the web-looping-region downstream-portion in such a manner so as to assume a central angle of substantially 15 degrees with respect to the web-looping-region center-portion.

Through employment of the above features, the turning bar apparatus of the present invention allows the web to be floated above the web-looping region of the turning bar and to run in a stable state.

Particularly, since air outlet openings are not arranged at the web-looping-region center-portion, an air-cushion effect is less susceptible to web tension, so that a stable air-cushion layer is formed there, thereby allowing the web to be floated uniformly and to run stably.

Further, since the web can be caused to stably run in a uniformly floated state, no friction is produced during travel of the web along the web-looping region of the turning bar, thereby reducing fluctuations in web tension and thus preventing a problem which would otherwise result from fluctuations in web tension. Thus, stable printing becomes possible in, for example, a rotary press.

Since the surface of the turning bar does not come into contact with the running web, good printing quality is provided, and less clogging of air outlet openings with ink and paper dust is involved to thereby facilitate maintenance of the turning bar apparatus.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

Turning bar apparatus 1 according to the embodiments of the present invention are adapted to change the running direction of web W. The turning bar apparatus 1 includes a stationary turning bar 2 assuming the form of a hollow cylinder and an unillustrated compressed-air supply unit for supplying compressed air 3 into the hollow interior of the turning bar 2. Air outlet openings 4 are formed in a portion of the surface of the turning bar 2 around which the web W is looped so as to change its running direction. The air outlet openings 4 extend through the wall of the turning bar 2 between the hollow interior of the turning bar and the outer circumferential surface of the turning bar. Air is discharged from the air outlet openings 4 so as to reliably float the web W above the surface of the turning bar 2, thereby eliminating friction between the turning bar 2 and the running web W for stable, smooth travel of the web W. The air outlet openings 4 are arranged on the turning bar 2 in a position which will be described later.

The turning bar 2 is disposed such that the running web W is looped therearound so as to change its running direction at a desired angle.

Figure 1:
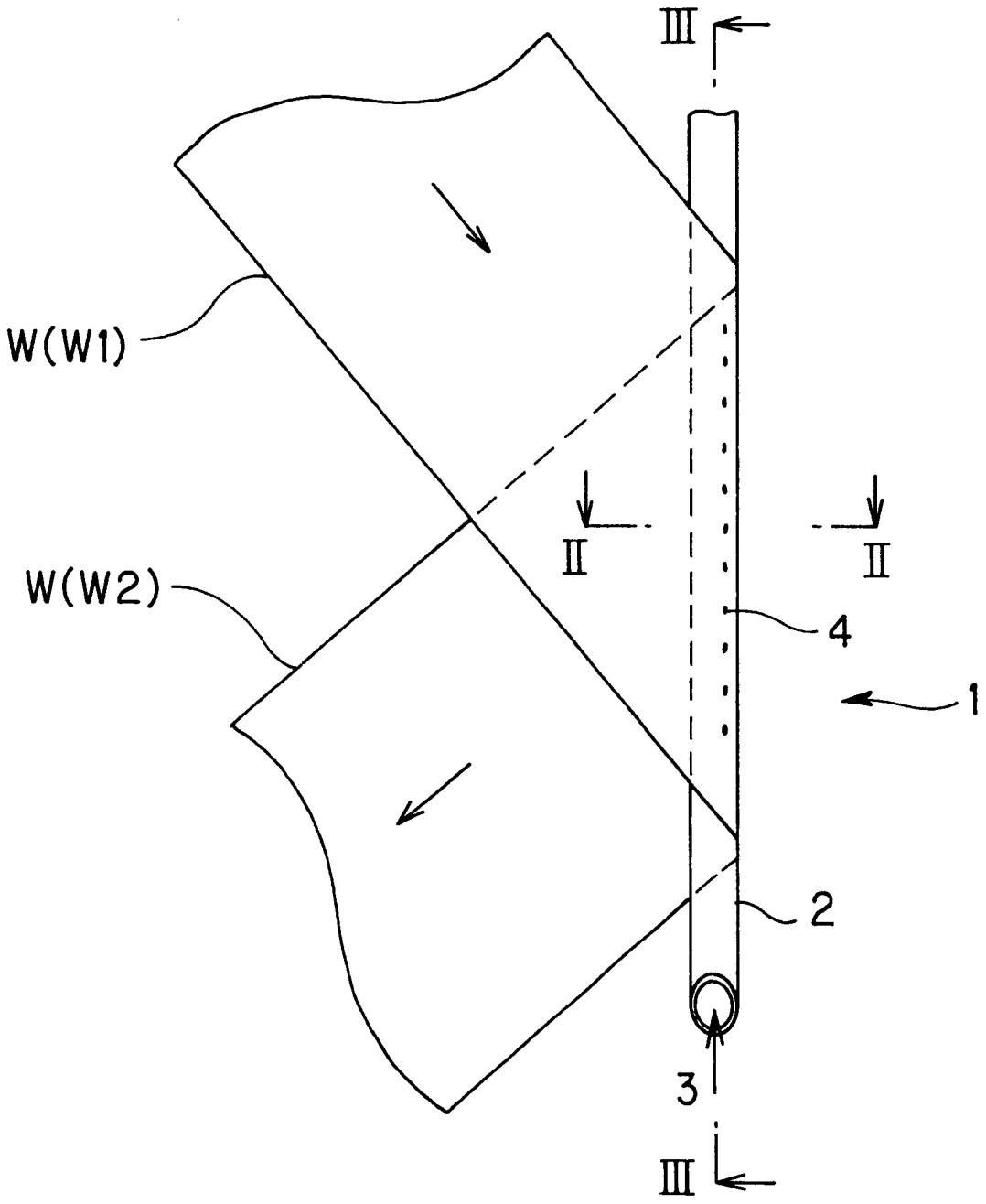
FIG. 1 is a perspective view of a turning bar according to embodiments of the present invention.

For example, as shown in FIG. 1, the turning bar 2 is disposed so as to form an angle of substantially 45 degrees with the running direction of an upstream web W1 which runs toward the turning bar 2 and with the running direction of a downstream web W2 which leaves the turning bar 2. The turning bar 2 guides the web W looped therearound, thereby changing the running direction of the web W substantially 90 degrees and turning the web W upside down.

Figure 5:
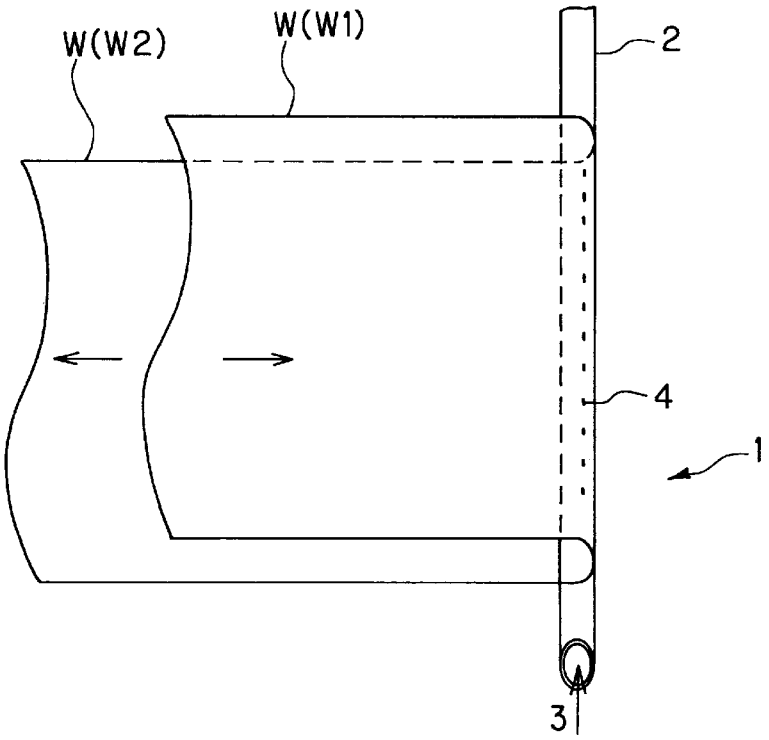
FIG. 5 is a perspective view showing another state of use of the turning bar of the present invention.
Figure 6:
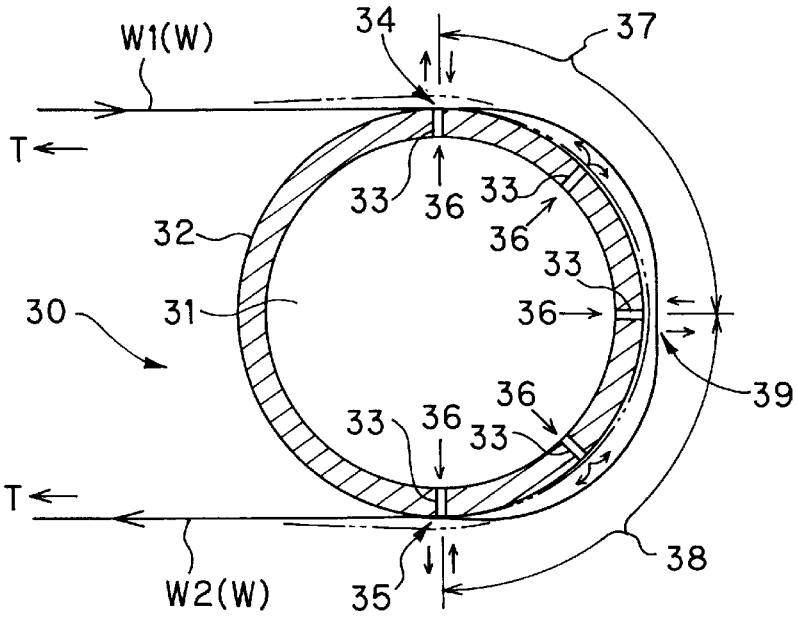
FIG. 6 (PRIOR ART)
FIG. 6 is a transverse sectional view of a conventional turning bar.
Figure 7A:
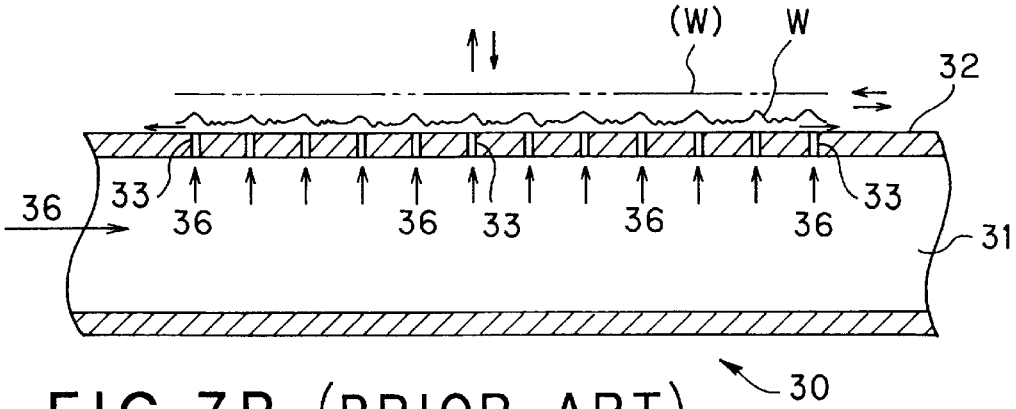
FIG. 7A (PRIOR ART)
FIGS. 7A and 7B are longitudinal sectional views of the conventional turning bar.
Figure 7B:
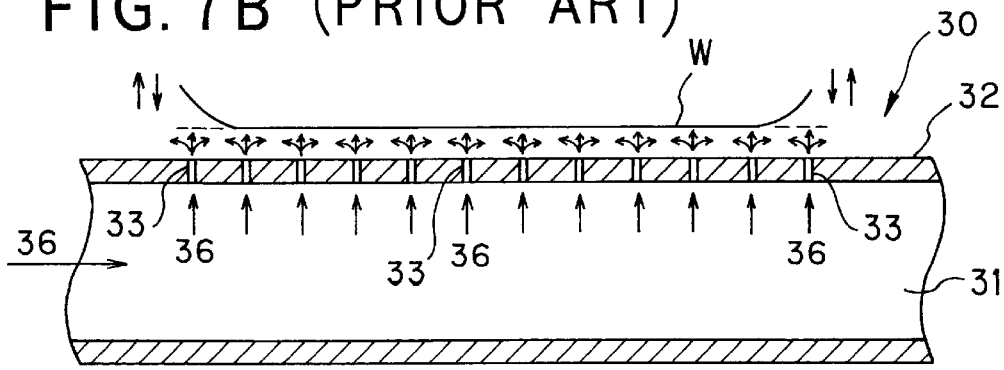
FIG. 7B (PRIOR ART)
Figure 8A:
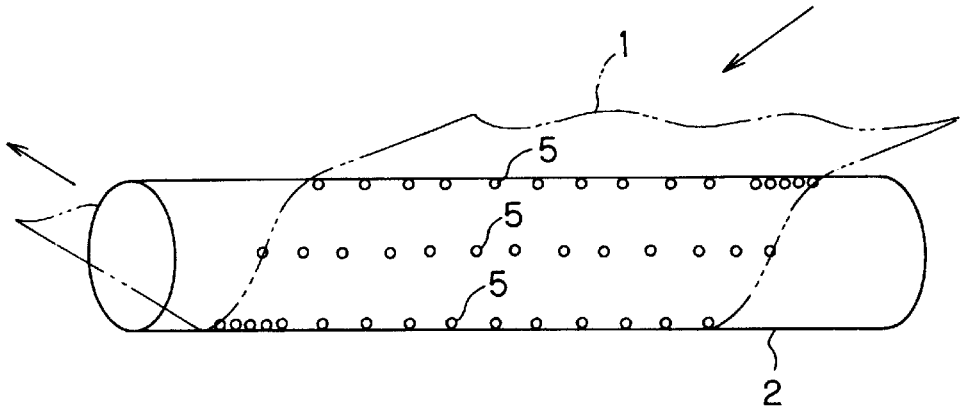
FIG. 8A (PRIOR ART)
FIGS. 8A and 8B are perspective views of another conventional turning bar.
Figure 8B:
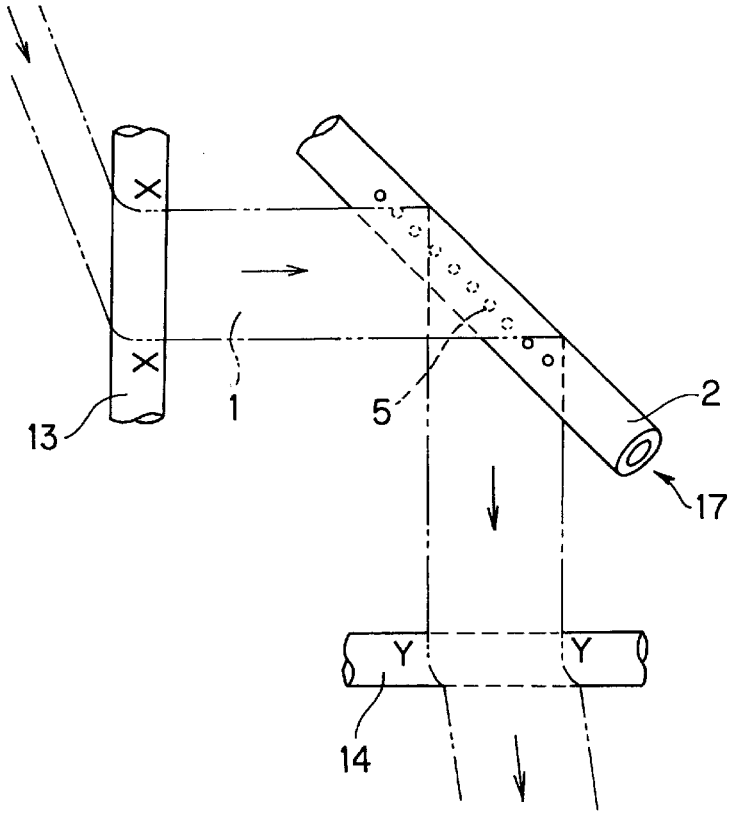
FIG. 8B (PRIOR ART)
Figure 9A:
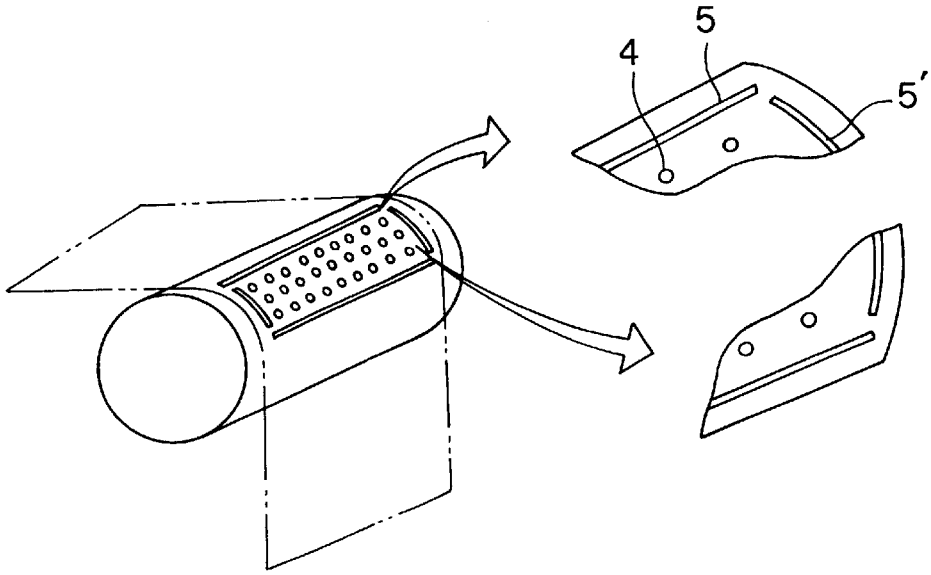
FIG. 9A (PRIOR ART)
FIGS. 9A and 9B are perspective and sectional views of another conventional turning bar.
Figure 9B:
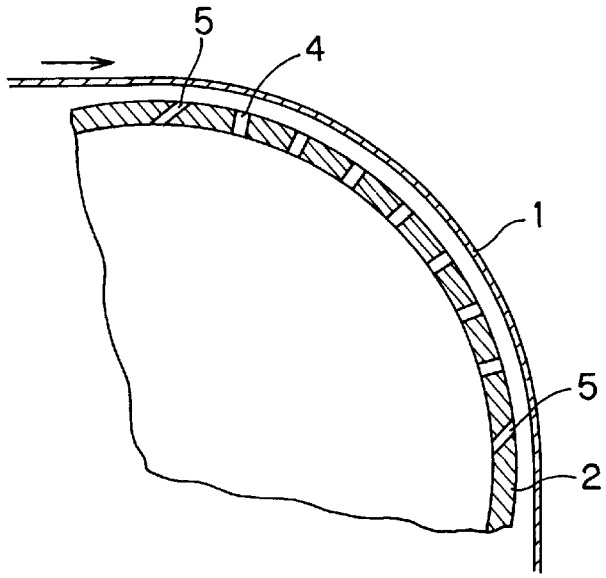
FIG. 9B (PRIOR ART)

The angle of changing the running direction of the web W is not limited to 90 degrees as shown in FIG. 1, but may be acute or obtuse. The turning bar 2 is disposed so as to form a desired angle with the running direction of the web W. For example, as shown in FIG. 5, when the running direction is to be changed substantially 180 degrees; i.e., when the running direction of the web W is to be reversed, the turning bar 2 is disposed perpendicularly to the traveling direction of the web W.

Arrangement of air outlet openings 4 formed in the outer circumferential surface of the turning bar 2 of the turning bar apparatus 1 according to a first embodiment of the present invention will next be described with reference to FIGS. 2 and 3.

Figure 2:
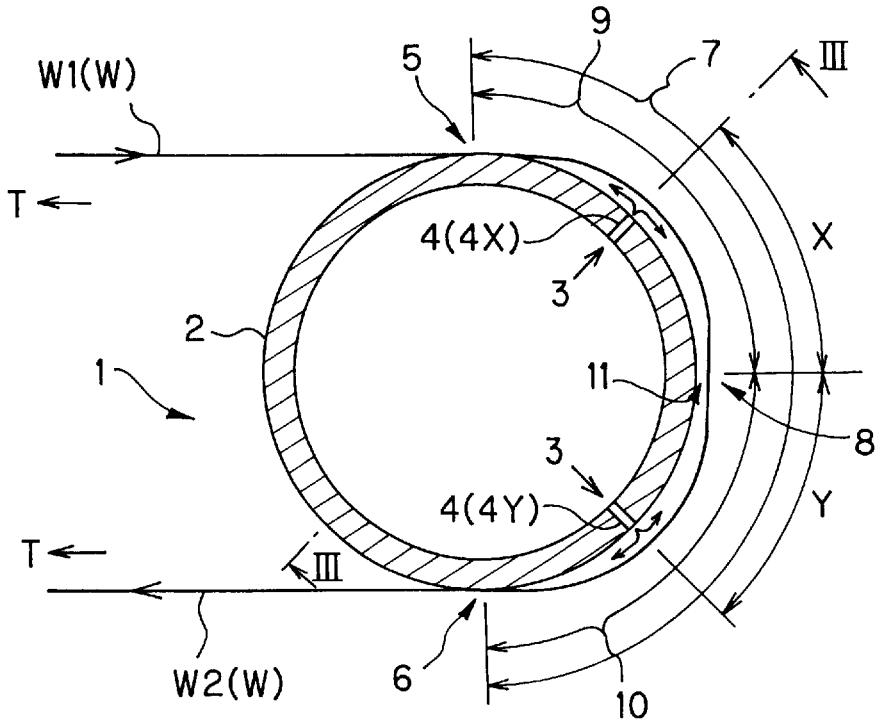
FIG. 2 is a transverse sectional view of the turning bar according to the first embodiment of the present invention (a sectional view taken along line II—II of FIG. 1)

As shown in FIG. 2, the air outlet openings 4 are positioned within a web-looping region 7 of the outer circumferential surface of the turning bar 2. The web-looping region 7 extends between a web-looping-region upstream-end-portion 5, which is where a web W1 running toward the turning bar 2 begins to be looped around the turning bar 2, and a web-looping-region downstream-end-portion 6, which is where a web W2 running away from begins to leave the turning bar 2. More specifically, the air outlet openings 4 are arranged in rows along the longitudinal direction of the turning bar 2 in a circumferential position which is located within a web-looping-region upstream-portion 9 extending between the web-looping-region upstream-end-portion 5 and a web-looping-region center-portion 8 located at the circumferential center of the web-looping region 7 and which forms a central angle X (of 5 degrees to 60 degrees) with the web-looping-region center-portion 8, as well as in a circumferential position which is located within a web-looping-region downstream-portion 10 extending between the web-looping-region center-portion 8 and the web-looping-region downstream-end-portion 6 and which forms a central angle Y (of 5 degrees to 60 degrees) with the web-looping-region center-portion 8.

Figure 3:
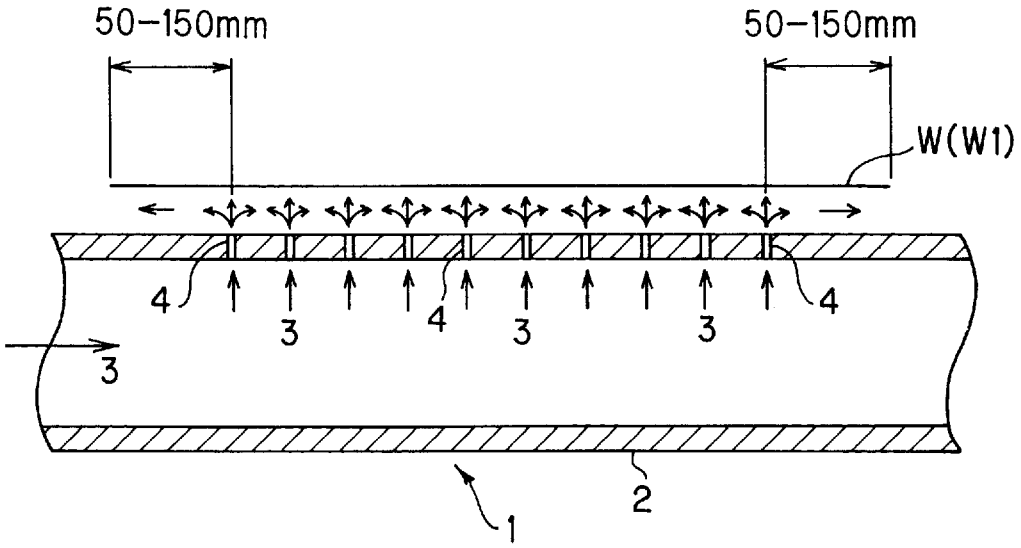
FIG. 3 is a longitudinal sectional of the turning bar of FIG. 2 (a sectional view taken along line III—III of FIG. 2)

Also, as shown in FIG. 3, air outlet openings 4 positioned at opposite ends of each row of air outlet openings 4 are located 50 mm to 150 mm inward from positions on the turning bar 2 which correspond to side edges of the web W looped around the turning bar 2.

Operation of the turning bar apparatus 1 according to the first embodiment will next be described.

Compressed air 3 is supplied from an unillustrated air supply unit into the hollow interior of the turning bar 2 and is then discharged from all the air outlet openings 4. Thus, the web W which is looped around the web-looping region 7 of the turning bar 2 so as to change its running direction 90 degrees is floated above the outer circumferential surface of the turning bar 2.

More specifically, in order to float the web W above the web-looping region 7 of the turning bar 2, the compressed air 3 is discharged from a plurality of air outlet openings 4X which are arranged within the web-looping-region upstream portion 9 along the longitudinal direction of the turning bar 2 and in a circumferential position forming a central angle X (of 45 degrees, for example) with the web-looping-region center-portion 8. Travel of the web W causes the thus-discharged air to flow through the gap between the web W and the web-looping region 7 of the turning bar 2 in the running direction of the web W while pressing the web W up.

As mentioned previously, at the web-looping-region center-portion 8 of the turning bar 2, a resultant force of a tension T of the web W1 which runs toward the turning bar 2 and a tension T of the web W2 which leaves the turning bar 2; i.e., the resultant force 2T directly acts on the web W. In other words, in the web-looping region 7, the maximum tension acts on the web W at the web-looping-region center-portion 8. Thus, the gap between the web W and the web-looping region 7 becomes minimum at the web-looping-region center-portion 8.

The compressed air 3 discharged from the air outlet openings 4X flows in the running direction of the web W as mentioned above and then reaches the web-looping-region center-portion 8 where an air path is throttled to become a throttled path 11. A portion of the air 3 enters the throttled path 11 and expands the throttled path 11, whereas the remaining portion of the air 3 flows in the width direction of the web W toward the side edges of the web W while expanding the throttled path 11, thereby causing the web W to float more at the throttled path 11.

The compressed air 3 is discharged from a plurality of air outlet openings 4Y which are arranged within the web-looping-region downstream-portion 10 along the longitudinal direction of the turning bar 2 and in a circumferential position forming a central angle Y (of 15 degrees, for example) with the web-looping-region center-portion 8. A portion of the discharged compressed air 3 merges with air which has passed through the throttled path 11 and helps press the web W up at the web-looping-region center-portion 8. The remaining portion of the discharged compressed air 3 flows in the running direction of the web W, thereby causing the web W to float in a circumferential region extending from the air outlet openings 4Y to the web-looping-region downstream-end-portion 6 of the turning bar 2.

In the circumferential positions where the air outlet openings 4X and 4Y are arranged, the resultant force 2T of the tension T of the web W1 and the tension T of the web W2 is not directly exerted on the web W, but web tension exerted on the web W is dispersively decreased. Thus, the web W does not vibrate.

As shown in FIG. 3, air outlet openings 4X (4Y) positioned at opposite ends of a row of air outlet openings 4X

(4Y) are located an appropriate distance of 50 mm to 150 mm (for example, 100 mm) inward from positions on the turning bar 2 which correspond to side edges of the web W looped around the turning bar 2. As a result, the compressed air 3 discharged from the air outlet openings 4X (4Y) does not cause unnecessarily intensive floating of the side-edge portions of the web W.

As described above, the circumferential positions of the air outlet openings 4 on the turning bar 2 are determined to avoid the position at which the tension T of the web W1 which runs toward the turning bar 2 and the tension T of the web W2 which leaves the turning bar 2 act on the web W most greatly, and also avoid the web-looping-region upstream-end-portion 5 and the web-looping-region downstream-end-portion 6. Therefore, it becomes possible to avoid the problems involved in conventional turning bars; i.e., the problem that the web W jitters due to the compressed air 3 jetted from the air outlet openings 4 at a position at which strong tensions T act on the web, and the problem that the web W flutters and causes transverse shift at positions at which the web W tends to become insatiable due to insufficient tensions or other causes.

Further, the air outlet openings 4 are formed on the turning bar 2 at positions at which the tensions T acting on the web W are dispersively decreased, while avoiding the position at which the largest force acts on the web W due to the tensions T. Thus, a portion of the compressed air 3 discharged from the air outlet openings 4 is caused to flow along the web W to the web-looping-region center-portion 8 at which the web W receives the tensions T most greatly, whereby the throttled path 11 is expanded, whereas the remaining portion of the air 3 flows in the width direction of the web W to thereby cause the web W to float. Thus, the web W is stably floated all the time.

Since the air outlet openings 4 are not arranged at the web-looping-region center-portion 8, a flow of air is not disturbed at the web-looping-region center-portion 8. Thus, the floating state of the web W is maintained stably and reliably. The running web W can be looped around the turning bar 2 without rubbing the outer circumferential surface of the turning bar 2.

The air outlet openings 4 positioned at opposite ends of a row of air outlet openings 4 are located 50 mm to 150 mm inward from positions on the turning bar 2 which correspond to side edges of the web W looped around the turning bar 2. As a result, the free side edges of the web W are less susceptible to the compressed air 3 discharged from the air outlet openings 4. Thus, the web W is not floated to an unnecessarily intensive extent, and thus runs stably without involvement of a transverse shift.

The turning bar apparatus 1 was tested for the floating state of the web W while the central angle of a row of air outlet openings 4 with respect to the web-looping-region center-portion 8 was varied. According to the test results, the web W was floated favorably when a row of air outlet openings 4X arranged in the web-looping-region upstream-portion 9 assumed a central angle of 10 degrees to 60 degrees with respect to the web-looping-region center-portion 8, and a row of air outlet openings 4Y arranged in the web-looping-region downstream-portion 10 assumed a central angle of 5 degrees to 50 degrees with respect to the web-looping-region center-portion 8.

Particularly, when the row of air outlet openings 4X assumed a central angle of 45 degrees, and the row of air outlet openings 4Y assumed a central angle of 15 degrees, the compressed air 3 discharged from the air outlet openings 4X formed the most stable air-cushion layer between the web W and the turning bar 2 in the web-looping region 7. A stably floating state of the web W was observed at the web-looping-region center-portion 8, where the effect of the web tensions T is most prominently yielded. The compressed air 3 discharged from the air outlet openings 4Y was found to function effectively for helping formation of and stably maintaining the air-cushion layer. The web W was floated substantially uniformly and was run stably.

The turning bar apparatus 1 was also tested for the positional relationship between the opposite end air outlet openings 4 of a row of air outlet openings 4 and the side edges of the web W looped around the turning bar 2. According to the test, when the air outlet openings 4 positioned at opposite ends of a row of air outlet openings 4 was located 50 mm to 150 mm inward from positions on the turning bar 2 which corresponded to side edges of the web W looped around the turning bar 2, the compressed air 3 discharged from the air outlet openings 4 did not turn up the side edge portions of the web W. Thus, the side edge portions of the web W did not flutter. The web W was floated substantially uniformly and was run stably.

Figure 4:
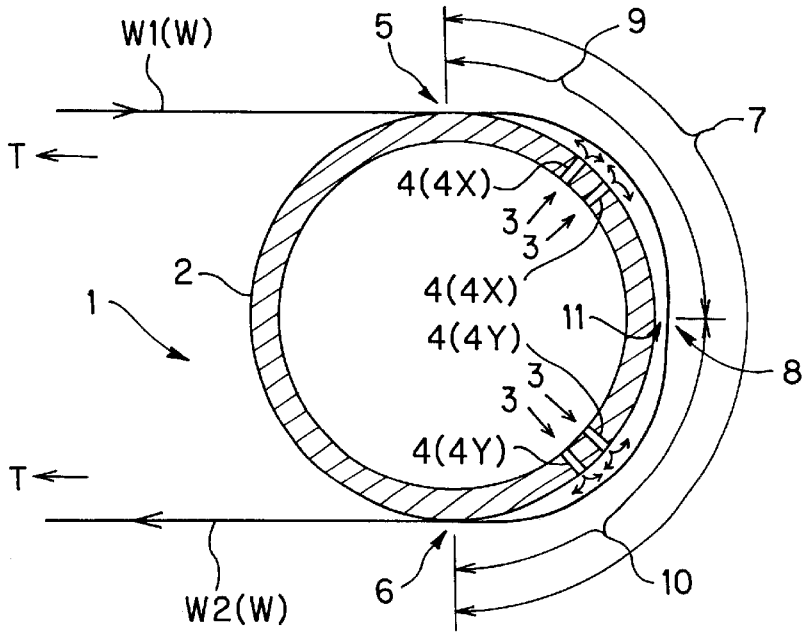
FIG. 4 is a transverse sectional view of the turning bar according to the second embodiment of the present invention (a sectional view taken along line II—II of FIG. 1)

FIG. 4 shows a turning bar apparatus 1 according to a second embodiment of the present invention. According to the second embodiment, the air outlet openings 4X are arranged in a plurality of rows in the web-looping-region upstream-portion 9 and the air outlet opennings 4Y are arranged in a plurality of rows in the web-looping-region downstream-portion 10. The turning bar apparatus 1 according to the second embodiment was tested in a manner similar to that of the first embodiment, ans was found to yield actions and effects similar to those which the turning bar apparatus 1 according to the first embodiment yielded.

Obviously, numerous modifications and variations of the present invention are possible in light of the above teachings. It is therefore to be understood that within the scope of the appended claims, the present invention may be practiced otherwise than as specifically described herein.

What is claimed is:

1. A turning bar apparatus comprising:

a stationary turning bar assuming a form of a hollow cylinder and adapted to change a running direction of a web looped therearound, the turning bar having a plurality of air outlet openings formed in a plurality of rows and along a longitudinal direction of the turning bar such that the air outlet openings extend through a wall of the turning bar between a hollow interior of the turning bar and an outer circumferential surface of the turning bar; and a compressed-air supply unit for supplying compressed air into the hollow interior of the turning bar, wherein the rows of air outlet openings are not located at a web-looping-region upstream-end-portion, which is a circumferential position of the turning bar where the web running toward the turning bar begins to be looped around the turning bar, at a web-looping-region downstream-end-portion, which is a circumferential position of the turning bar where the web looped around the turning bar begins to leave the turning bar, or at a web-looping-region center-portion, which is a circumferentially center position of the turning bar between the web-looping-region upstream-end-portion and the web-looping-region downstream-end-portion; and at least a single row of air outlet openings is arranged in each of a web-looping-region upstream-portion extending between the web-looping-region upstream-end-portion and the web-looping-region center-portion and a web-looping-region downstream-portion extending between the web-looping-region-center portion and the web-looping-region downstream-end-portion.

2. A turning bar apparatus according to claim 1, wherein air outlet openings positioned at opposite ends of each row of air outlet openings are located 50 mm to 150 mm inward from positions on the turning bar corresponding to side edges of the web looped around the turning bar.

3. A turning bar apparatus according to claim 1, wherein the rows of air outlet openings are located within a circumferential range between circumferential positions having central angles of 5 and 60 degrees, respectively, with respect to the web-looping-region center-portion.

4. A turning bar apparatus according to claim 3, wherein a single row of air outlet openings is arranged within the web-looping-region upstream-portion in such a manner so as to assume a central angle of substantially 45 degrees with respect to the web-looping-region center-portion, and a single row of air outlet openings is arranged within the web-looping-region downstream-portion in such a manner so as to assume a central angle of substantially 15 degrees with respect to the web-looping-region center-portion.

5. A turning bar apparatus according to claim 2, wherein the rows of air outlet openings are located within a circumferential range between circumferential positions having central angles of 5 and 60 degrees, respectively, with respect to the web-looping-region center-portion.

6. A turning bar apparatus according to claim 5, wherein a single row of air outlet openings is arranged within the web-looping-region upstream-portion in such a manner so as to assume a central angle of substantially 45 degrees with respect to the web-looping-region center-portion, and a single row of air outlet openings is arranged within the web-looping-region downstream-portion in such a manner so as to assume a central angle of substantially 15 degrees with respect to the web-looping-region center-portion.

* * * * *